United States Patent [19]

Hallam

[11] 4,216,725

[45] Aug. 12, 1980

[54] COMBINATION DOOR AND EMERGENCY STAIRWAY EXIT

[75] Inventor: Keith J. Hallam, Merrillville, Ind.

[73] Assignee: Pullman Incorporated, Chicago, Ill.

[21] Appl. No.: 960,428

[22] Filed: Nov. 13, 1978

[51] Int. Cl.[2] ..... B61D 19/00; B61D 23/02

[52] U.S. Cl. ..... 105/348; 105/443; 49/141; 296/146

[58] Field of Search ..... 105/348, 349, 398, 343, 105/443; 296/146; 49/141

[56] References Cited

U.S. PATENT DOCUMENTS

| | | | |
|---|---|---|---|
| 2,453,937 | 11/1948 | Ray | 105/348 X |
| 2,531,263 | 11/1950 | Fink et al. | 244/129 |
| 3,776,143 | 12/1973 | Cox et al. | 105/343 |
| 3,861,739 | 1/1975 | Kinney | 296/146 |

*Primary Examiner*—Richard A. Bertsch
*Attorney, Agent, or Firm*—Richard J. Myers

[57] ABSTRACT

A combination end door and emergency stairway unit operates as a conventional rapid transit door to allow movement between cars. The unit also includes an auxiliary door inner frame pivotally mounting a staircase that may be rotated and lowered to the ground to allow passengers to alight from the vehicle. A locking, linkage mechanism securely interconnects the auxiliary door, the inner frame, and the movable staircase to form the vehicle end door unit.

10 Claims, 7 Drawing Figures

COMBINATION DOOR AND EMERGENCY STAIRWAY EXIT

BACKGROUND OF THE INVENTION

1. Field of the Invention

This disclosure relates to a rapid transit vehicle and in particular to the end door which is a composite door that may be swung as a conventional door to allow movement between adjacent cars, and which also may be separated to provide a stairway for emergency exit from the vehicle.

2. Description of the Prior Art

While the prior art has shown closure members which act as both doors and stairways, these structures have been restricted to aircraft in which both the door and stairway move pivotally downwardly. Such structure is shown in the Ray U.S. Pat. No. 2,453,937 (1948), and in Fink et al, U.S. Pat. No. 2,531,263 (1950). While these patented structures apparently work well with aircraft, they are not suitable for railway passenger vehicles because such vehicles must have hinges which allow the door to swing laterally of the door opening.

Other types of emergency exits have been used with motor vehicles such as that disclosed in the bus of the Kinney U.S. Pat No. 3,861,739 (1975). Such an emergency exit merely provides a door that can be used as a slide to allow passengers to alight from a motor vehicle. Such construction is undesirable for use with rapid transit vehicles because of chance of injury due to the greater height of the passenger platform above the ground.

SUMMARY OF THE INVENTION

This disclosure relates to railway passenger vehicles of a so-called rapid transit variety. As is well known, rapid transit vehicles have side doors at platform level to allow passengers to board and alight. The rapid transit vehicles also include end doors which allow a motorman, conductor, and passengers to move between adjacent cars.

Occasionally rapid transit vehicles are forced to stop at a location other than the station platform. This occurs periodically because of equipment malfunction, derailments, or collisions making it necessary for the passengers to be assisted from the vehicle because of the height of the passenger level above the tracks. Because of this height of the car platform being above the supporting tracks, it is often difficult because of age or physical infirmities for passengers to alight from the vehicle. There is always a danger of some passengers being injured in jumping from the platform to the track. Consequently, it is desirable to provide a special stairway or method of alighting from a vehicle in the event these emergency departures are required.

Generally, the end door disclosed provides a dual purpose closure which may be used as a conventional hinged door which moves laterally into and from its door opening. The door structure also includes a stairway that may be moved pivotally out of the door opening until its lower end contacts the ground to provide a safe structure for passengers to disembark quickly and safely.

Specifically, the door unit provides an outer door section which also can serve as a stairway. An inner or auxiliary door is hinged to swing open and closed to provide access to the stairway. Both the auxiliary door and stairway are mounted in an inner frame which swings with these members to provide the conventional door for passage between cars. The inner frame is securely locked in the door opening when the auxiliary door and stairway are released to open the doorway and to allow passengers to alight in emergencies.

A locking mechanism interconnects the hinged stairway, the auxiliary door, and inner door frame to allow these members to form a composite, standard door. When the locking mechanism is actuated, the auxiliary door is released from the inner frame and may swing inwardly into the car. At the same time, the mechanism also releases the stairway and allows it to pivot downwardly from the door opening to the ground. A shock absorber unit is attached to the car and the stairway to allow the stairway to be released in a controlled fashion. The shock absorber unit also serves the purpose of providing a hand rail and guide for passengers.

Thus, it is an object of this disclosure to provide a dual purpose door unit for a rapid transit car. The door may function both as a conventional swinging door for passenger movement between cars and also functions in emergencies as a stairway to allow passengers to alight safely from the railway vehicle.

These and other objects of the invention will become apparent to those having ordinary skill in the railway passenger art with reference to the following description, drawings and claims.

DESCRIPTION OF THE PREFERRED EMBODIMENT

Figure 1:
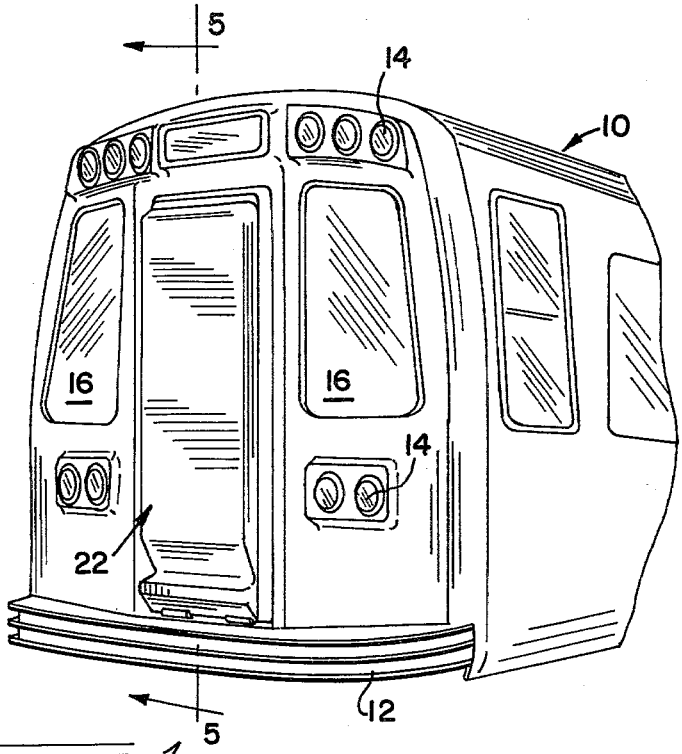
FIG. 1 is a pictorial illustration of an end of a rapid transit vehicle showing the dual function door disclosed herein.
Figure 2:
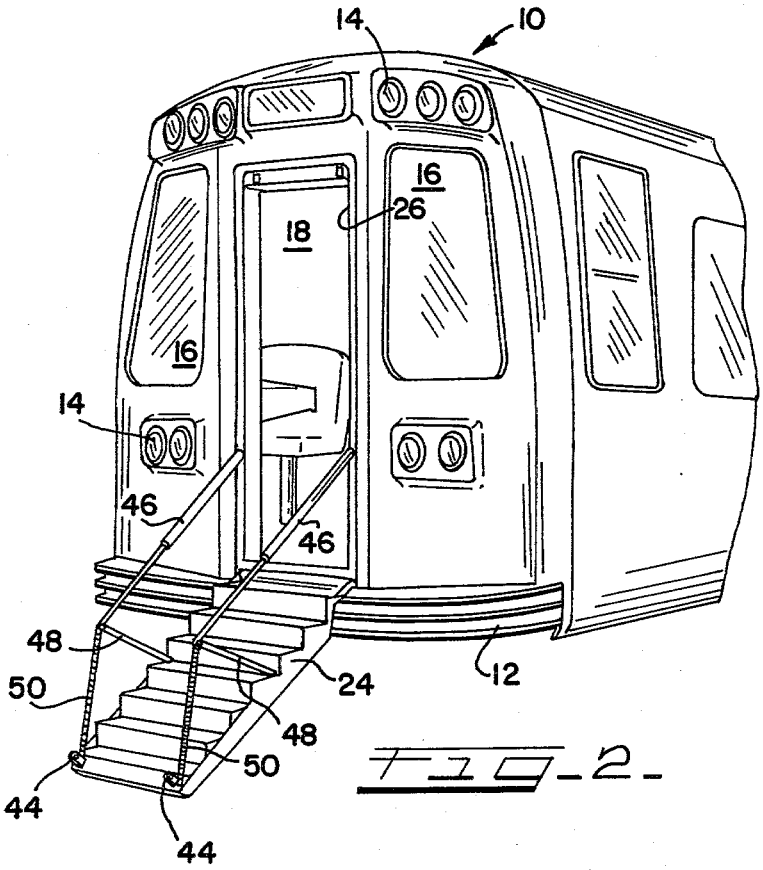
FIG. 2 is a pictorial illustration showing a stairway portion of the door in a deployed position.

Referring now to the drawings and in particular to FIG. 1, there is shown a rapid transit vehicle designated generally by the numeral 10. The transit vehicle 10 includes usual end sill 12 and marker and observation lights 14. The front portion of the vehicle includes a pair of windows 16 and a usual motorman's compartment 18 (FIG. 2).

Figure 4:
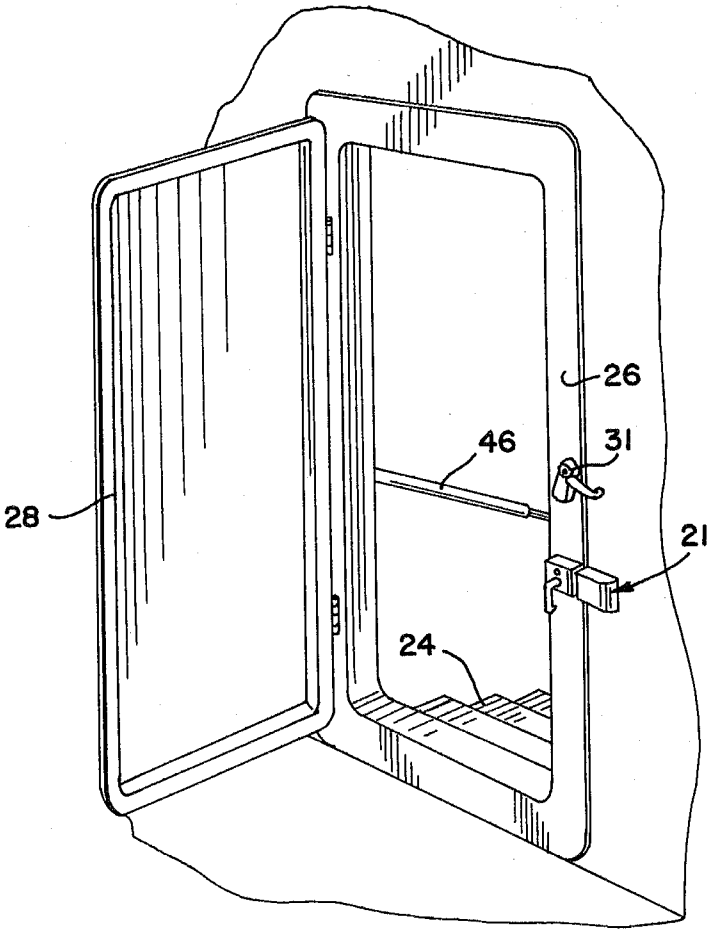
FIG. 4 is a pictorial illustration showing the door unit appearing in the stair-down position.
Figure 3:
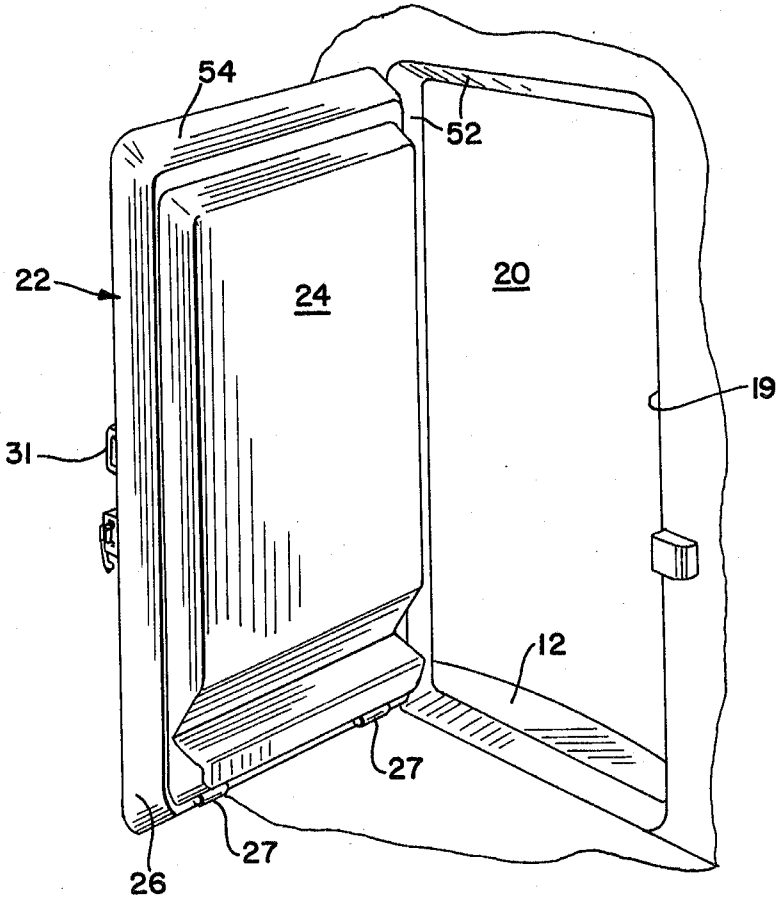
FIG. 3 is a pictorial illustration showing the door unit in an open position.

As shown in FIG. 3, the end of the car has a door frame 19 which extends about a door opening 20. A composite door unit disclosed herein is designated 22 and may be held securely in place and opened at the door opening 20 with a conventional lock 21. It is noticed from FIGS. 3,4 and 5, the door 22 is a composite or builtup member composed of a stairway 24, and inner frame 26 and an inner or auxiliary door 28. Stairway 24 is attached for upward and downward pivotal movement by hinges 27 at its bottom to the frame 26.

A connector mechanism 30 (FIG 6) holds the stairway 24, inner frame 26 and auxiliary door 28 in a rigid, closed configuration whereby the three members are securely held together and may function as a conventional door unit. Connector mechanism 30 includes a latch portion 32 which extends to abutt an associated part of the auxiliary door 28 to securely hold the door 28 in position attached to frame 26. A manually-grasped operating handle 33 is provided for actuating the mechanism 30. Operating link 34 is connected to an upwardly extending operating rod 36. Bell crank 38 is located at the top corner of the inner frame 26 and has a locking rod 40 extending laterally therefrom being slidably supported by a pair of guide means 43. A pair of locking fingers 42 extend from locking rod 40 and engage associated latch lugs 44 which are connected with the bottom portions of the stairway 24. Thus, it is noticed that by attaching connector mechanism 30 to the inner frame 26 it serves to securely attach the auxiliary door 28 and the stairway 24 about the frame 26 to provide a single unit that moves as a conventional door into and from the door opening 20.

Figures 5, 6, 7:
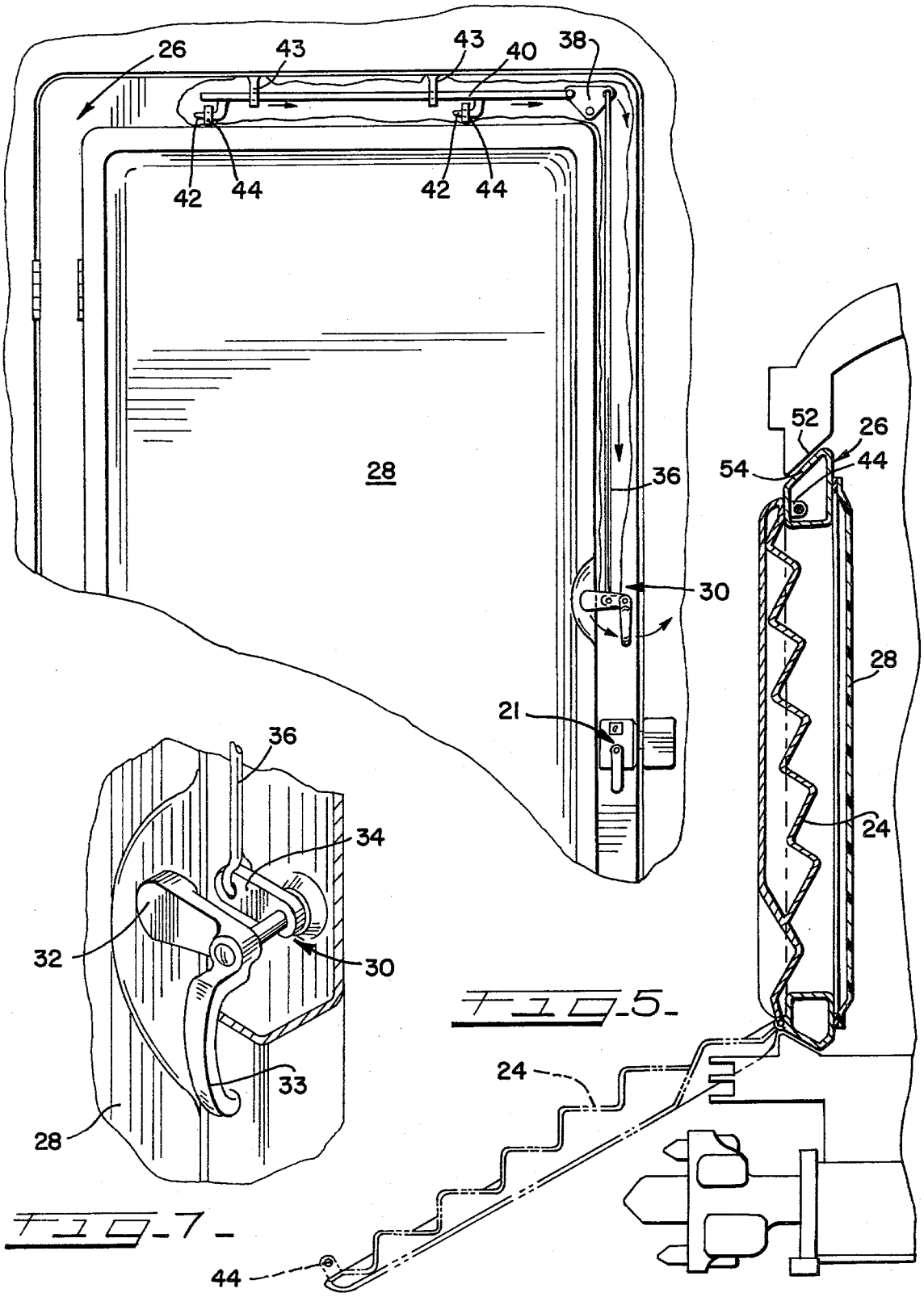
FIG. 5 is a sectional view taken generally along the lines 5-5 of FIG. 1.
FIG. 6 is an enlarged view with portions removed showing the top portion of the door unit and in particular the locking mechanism which connects the auxiliary door, door frame, and stairway unit.
FIG. 7 is an enlarged, removed pictorial illustration of the locking mechanism.

Referring now to FIG. 6, it is noticed that when the locking mechanism 30 is actuated to disengage locking fingers 42 from the latch lugs 44, the stairway 24 is allowed to pivot about hinges 27 and move out of the door opening 20 toward the ground. To control the the speed at which the stairway moves, a pair of shock absorber members 46 may be provided on each side of the stairway. A pair of diagonals 48 extend upwardly to the end portions of the shock absorber unit and meet with a pair of flexible supports 50. With this construction the shock absorbers 46 function not only to limit and control movement of the stairway 24 but also provide hand rails for passengers alighting from the vehicle. With the arrangement shown in FIG. 2, the shock absorber-hand rail unit 46 telescopes together and the supporting members 48, 50 fold compactly along side the shock abosrber 46 in a space-saving fashion.

As shown in FIG. 5, the door frame 19 has a beveled portion 52 extending thereabout which cooperates with an associated angular portion 54 of the inner frame 26. These angle surfaces provide a seal between the door frame 19 and the inner door frame 26.

The components of the door 22 may be constructed from a light weight but strong fiber glass or plastic material.

Thus, it has been shown that this disclosure provides a reliable and functional way of providing an end door for a rapid transit vehicle which may be used in emergency situations as a stairway to allow passengers to alight in a safe, speedy manner.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A combination end door and emergency stairway unit for passengers on a railway vehicle, the improvement comprising:

a door frame surrounding a door opening;

a modular door unit;

said modular door unit having an inner door frame;

hinge means for movement of the inner door frame from a position into and from said door opening;

auxiliary door means attached to the inner door frame and having means for hinged movement into and from said inner door frame;

an outer closure member mounted on said inner door frame; and means for pivotally moving said outer closure member from an upright position adjacent the inner door frame to an inclined position extending from the door opening to allow passengers to safely alight from the passenger vehicle.

2. The door unit of claim 1 and;

a mechanism with means interconnecting the auxiliary door means, inner door frame, and outer closure member;

said mechanism comprising means mounted to the inner door frame and having means extending therefrom and cooperative with portions of the auxiliary door and outer closure member.

3. The door arrangement of claim 2 wherein said mechanism includes:

a handle portion;

link means operatively connected with the handle portion and rotatable therewith;

linkage members with means responsive to movement of link member;

locking finger means with means extending from said link members;

said second closure member including latch lugs with means operatively aligned with the locking fingers for receiving said fingers to securely attach the outer closure member with the inner door frame.

4. The door arrangement of claim 3 wherein said locking mechanism includes:

means mounting the locking handle to the inner door frame;

first and second link members extending upwardly and horizontally respectively;

bell crank means operatively connecting the first and second link members whereby rotation of the operating handle moves the linkage members for locking and unlocking the door unit.

5. The door unit of claim 1 wherein said outer closure member comprises:

hinge means for pivotally mounting the closure member to the inner frame;

step means extending along the length of the closure member and providing means for ingress and egress to and from the vehicle.

6. The invention in accordance with claim 1 and, said second locking mechansim including latching means cooperative with the outer closure member for retaining same in the up position, and said lock mechanism further including abutment means swingable into obstructing relationship with respect to said auxiliary door.

7. The invention in accordance with claim 1, further including shock absorption means for controlling and guiding the movement of said outer closure members.

8. The invention in accordance with claim 7, said shock absorption means including a pair of shock absorbers each having first end pivotally connected to said door frame, and each having a second end pivotally connected with a support bar, each support bar in turn being pivotally connected to said outer closure member.

9. The invention in accordance with claim 8 and, flexible support means extending between the second end of each shock absorber and the outer closure member.

10. The combination of outer door and stairway unit for passengers on a railroad vehicle comprising:

a door unit adapted to close a door opening in said vehicle, said door unit including a door frame for pivotally mounting the door unit in said door opening, an outer closure member pivotally mounted on a lower portion of said door frame for movement about a generally horizontal axis from an up to a down position, an auxiliary door pivotally mounted on an inner side of said door frame about a generally vertical axis for movement of the auxiliary door between an open position and a closed position against the door frame, door locking means including a first locking mechanism adapted to lock said door frame in the door opening, and a second locking mechanism mounted on the said door frame cooperative with the auxiliary door for retaining same in a closed position against the door frame and for locking said outer closure member in the up position against an outer said door frame, and said locking means being releaseable for pivoting of both said auxiliary door to the open position and said outer closure member to the down position for safe exit from said vehicle.

* * * * *